US010869134B2

(12) United States Patent
Zhang et al.

(10) Patent No.: US 10,869,134 B2
(45) Date of Patent: Dec. 15, 2020

(54) SPEAKER INCLUDES TWO SYMMETRICAL VOICE COILS DISPOSED IN PARALLEL AND INTEGRALLY WOUND MOLDED

(71) Applicant: AAC Technologies Pte. Ltd., Singapore (SG)

(72) Inventors: Tong Zhang, Shenzhen (CN); Chengming Cao, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,159

(22) Filed: Jul. 28, 2019

(65) Prior Publication Data

US 2020/0045451 A1 Feb. 6, 2020

(30) Foreign Application Priority Data

Aug. 1, 2018 (CN) ..... 2018 2 1236270 U

(51) Int. Cl.

| | |
|---|---|
| ***H04R 9/04*** | (2006.01) |
| ***H04R 9/06*** | (2006.01) |
| ***H04R 9/02*** | (2006.01) |
| ***H04R 7/18*** | (2006.01) |
| *H04R 7/12* | (2006.01) |

(52) U.S. Cl.

CPC ..... *H04R 9/046* (2013.01); *H04R 7/18* (2013.01); *H04R 9/025* (2013.01); *H04R 9/06* (2013.01); *H04R 7/127* (2013.01); *H04R 2400/11* (2013.01)

(58) Field of Classification Search

CPC ... H04R 9/00; H04R 9/02; H04R 9/04; H04R 9/046; H04R 2209/041

See application file for complete search history.

(56) References Cited

U.S. PATENT DOCUMENTS

| | | | | |
|---|---|---|---|---|
| 8,379,904 | B2 * | 2/2013 | Liu | H04R 9/063 181/181 |
| 2010/0215208 | A1 * | 8/2010 | Sadaie | H04R 1/227 381/407 |
| 2013/0016874 | A1 * | 1/2013 | Huang | H04R 9/043 381/433 |

* cited by examiner

*Primary Examiner* — Walter F Briney, III

(74) *Attorney, Agent, or Firm* — W&G Law Group LLP

(57) ABSTRACT

The present disclosure provides a speaker, comprising a basin frame with a receiving space, a vibration system disposed at the basin frame, and a magnetic circuit system configured for driving the vibration system to generate sounds by vibration, the vibration system comprises a diaphragm with an outer edge fixedly held by the basin frame and a voice coil configured for driving the diaphragm to vibrate, the voice coil includes a first voice and a second voice coil fixedly connected to the first voice coil, the first and second voice coils are disposed in parallel and symmetrically, the first and second voice coils are integrally wound molded and the winding direction of the first voice coil is opposite to that of the second voice coil. The speaker provided by the present disclosure could improve utilization of magnetic field, provide better vibration effect and reduce resonance frequency.

5 Claims, 3 Drawing Sheets

SPEAKER INCLUDES TWO SYMMETRICAL VOICE COILS DISPOSED IN PARALLEL AND INTEGRALLY WOUND MOLDED

TECHNICAL FIELD

The present disclosure relates to the field of electro-acoustic conversion, in particular to a speaker.

BACKGROUND

With the rapid development of wireless communication, mobile phones are widely used in the world. The demand for mobile phones is not limited to basic calls, but more requirements on the reliability of traditional mobile phones are put forward. Especially as 3G times is coming, mobile multimedia technology has also developed, and many mobile phones have a variety of entertainment functions, such as video playback, digital camera, games, GPS navigation.

The speakers according to the related art are generally provided with a basin frame, a vibration system and a magnetic circuit system. The magnetic circuit system includes a magnetic bowl provided with a magnetic bowl side wall and a magnetic steel assembled in the magnetic bowl and forming a magnetic gap with the magnetic bowl, the vibration system includes a diaphragm, a spider and a voice coil, and the voice coil is suspended in the magnetic gap.

The existing speakers generally include one voice coil, or include dual voice coils surrounding one another in which one of the coils is larger and the other is smaller (that is, the smaller voice coil is surrounded by the larger voice coil). The utilization of the magnetic field generated by a single voice coil is low. Especially when the length to width ratio of the magnetic steel are relatively large, the utilization of the magnetic field generated by the central portion of the magnetic steel is low, thus the vibration driving force of the speaker is not large. For the structure of voice coils surrounded with each other, a great difficulty is presented when winding the incoming and outgoing lines of the internal smaller voice coil, and the internal smaller voice coil easily causes an interfere with the magnetic steel, the polar core, etc., the processing thereof is difficult, the magnetic circuit system is complicated, and the production cost is high.

Therefore, it is necessary to provide a new speaker to solve the above technical problems.

BRIEF DESCRIPTION OF THE DRAWINGS

In order to more clearly describe the technical solutions in the embodiments of the present invention, the drawings used in the description of the embodiments will be briefly described below. It is obvious that the drawings in the following description only relate to some embodiments of the present invention. For those skilled in the art, other drawings may also be obtained according to the accompanying drawings without any creative work, wherein.

DETAILED DESCRIPTION

The technical solutions in the embodiments of the present invention are clearly and completely described in the following with reference to the accompanying drawings in the embodiments of the present invention. It is obvious that the described embodiments are only a part of the embodiments of the present invention, but not all of the embodiments. All other embodiments obtained by those skilled in the art based on the embodiments of the present invention without creative work fall within the scope of the present invention.

Figure 1:
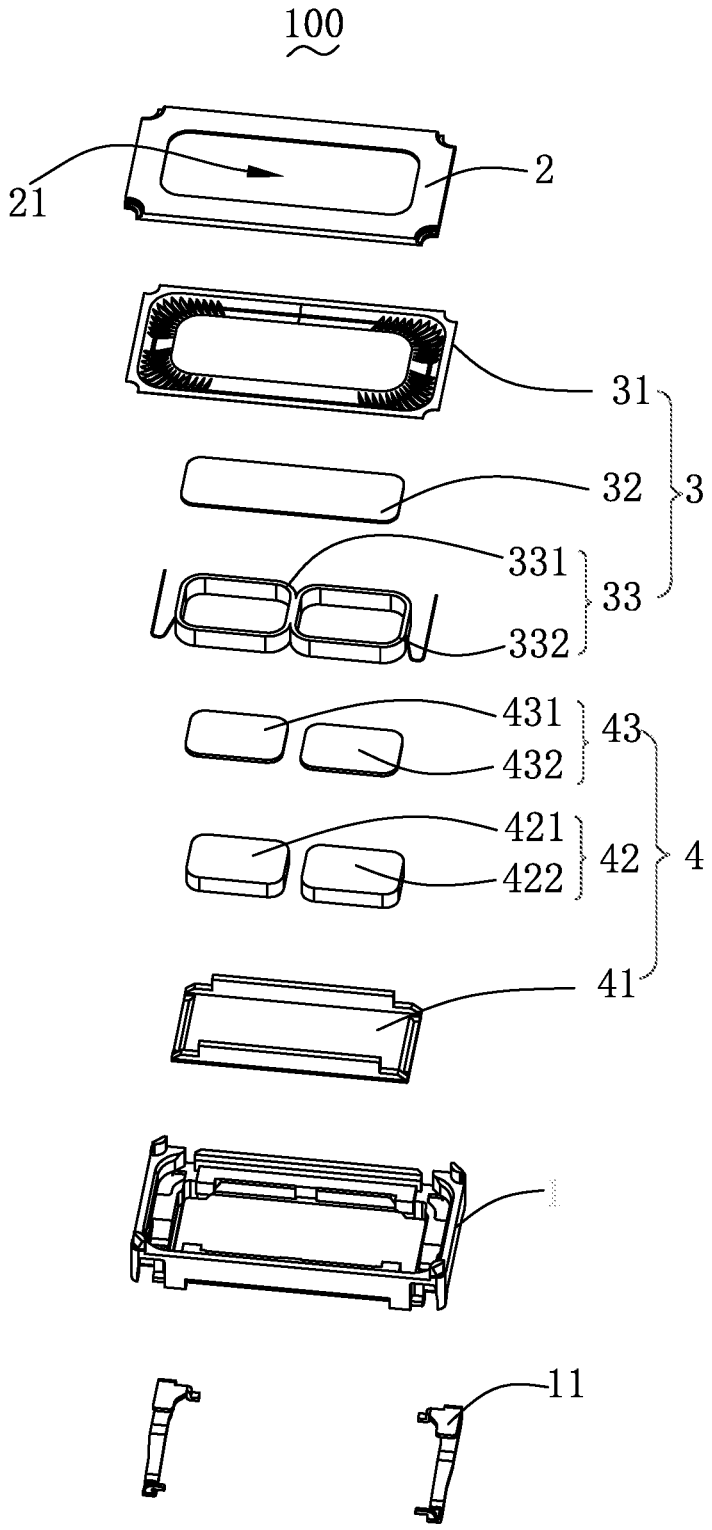
FIG. 1 is a schematic exploded view illustrating a speaker according to the present invention.
Figure 2:
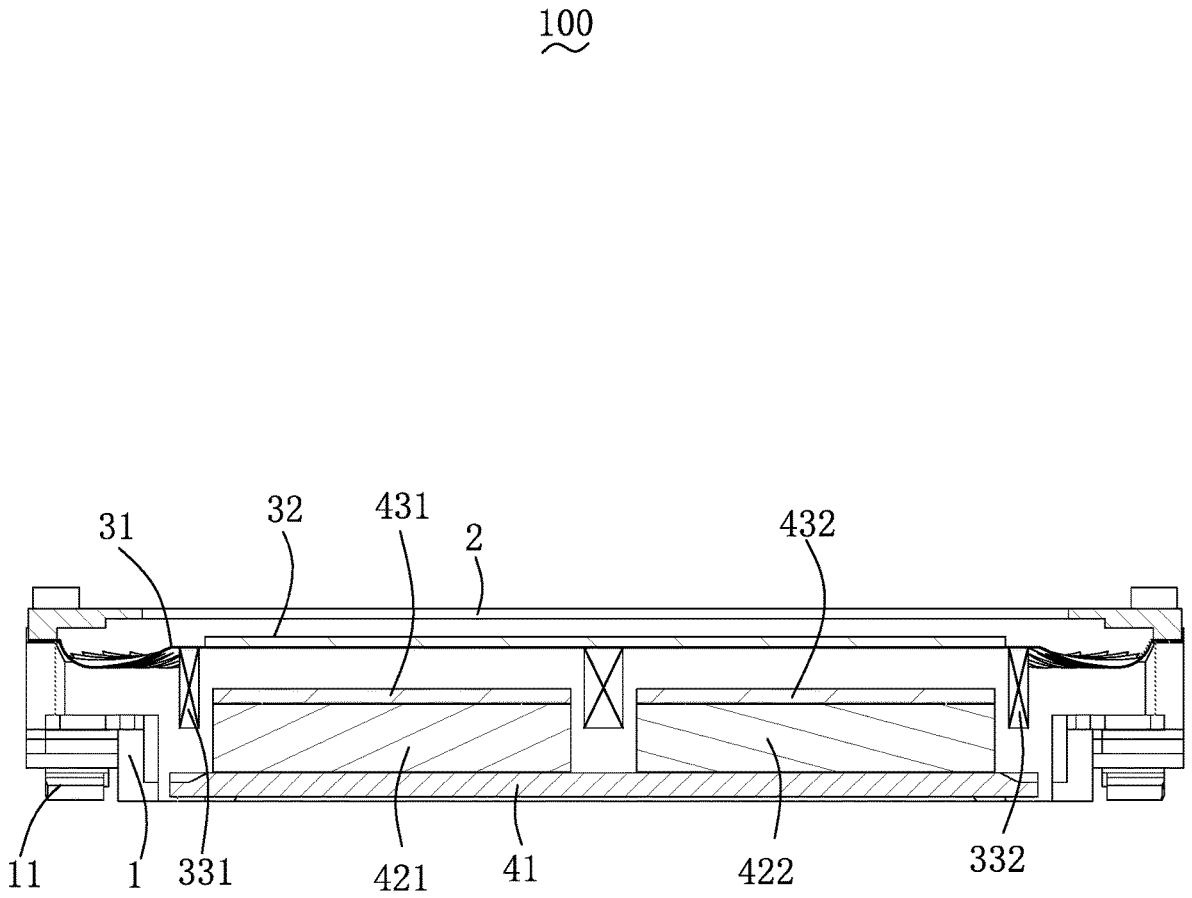
FIG. 2 is a section view illustrating the speaker according to the present invention.

Referring to FIGS. 1 and 2, the speaker 100 includes a basin frame 1, a front cover 2, a vibration system 3, and a magnetic circuit system 4.

The basin frame 1 has a receiving space for receiving the vibration system 3 and the magnetic circuit system 4.

The front cover 2 is configured to fit with the basin frame 1 to form the receiving space. The front cover 2 is provided with an opening portion 21 thereon. The opening portion 21 is configured for transmitting sounds generated by vibration of the vibration system 3.

The vibration system 3 includes a diaphragm 31, a dome 32 disposed in the middle of the diaphragm 31, and a voice coil 33 disposed on a side of the diaphragm 31 away from the dome 32. The voice coil 33 is configured for driving the diaphragm 31 and the dome 32 to generate sounds by vibration.

The voice coil 33 includes a first voice coil 331 and a second voice coil 332 fixedly connected to the first voice coil 331; the first voice coil 331 and the second voice coil 332 are disposed symmetrically and in parallel. The first voice coil 331 and the second voice coil 332 are integrally wound-molded, and the first voice coil 331 and the second voice coil 332 have the same height. By disposing two voice coils in parallel and symmetrically, the utilization of the magnetic field is increased, and thereby vibration driving force is increased; and the mass of the voice coils is increased due to the two coil structure, thus the resonance frequency of the speaker 100 is reduced.

The magnetic circuit system 4 includes a magnetic bowl 41 fixedly held by the basin frame, a magnetic steel 42 fixedly held by the magnetic bowl 41 and spaced apart from the magnetic bowl 41 for forming a magnetic gap, and a pole core 43 adhered to the magnetic steel 42, one end of the voice coil 33 is fixed to the diaphragm 31 and the other end is suspended in the magnetic gap.

The magnetic steel 42 includes a first magnetic steel 421 fitted with the first voice coil 331 and a second magnetic steel 422 fitted with the second voice coil 332, the first magnetic steel 421 and the second magnetic steel 422 are spaced apart and in parallel, and the magnetic field of the first magnetic steel 421 is opposite to that of the second magnetic steel 422. By using magnetic steels with small volume, the magnetic field leakage of the speaker 100 could be greatly reduced, and interference to other electrical components could be avoided; and the vibration is more stable by fitting the first magnetic steel 421 and the second magnetic steel having opposite magnetic fields with the first voice coil 331 and the second voice coil 332 having opposite winding directions.

The corresponding pole core 43 includes a first pole core 431 adhered to the first magnet steel 421 and a second pole core 432 adhered to the second magnet steel 422. The pole core 43 is configured to magnetical-conductively strengthen magnetic field strength.

Figure 3:
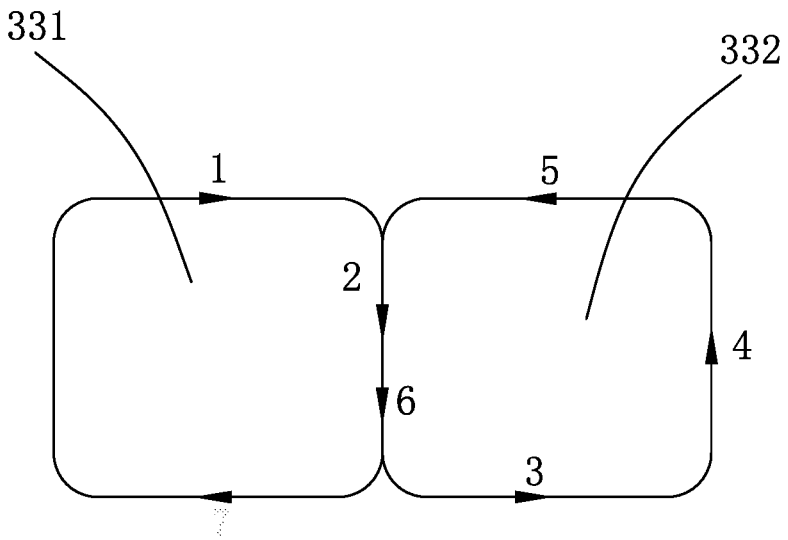
FIG. 3 is a schematic view illustrating a wound path for two coils of the speaker according to the present invention.

Referring to FIG. 3, the first voice coil 331 and the second voice coil 332 are integrally wound and the winding direction of the first voice coil 331 is opposite to that of the second voice coil 332. Specifically, the winding is started with winding the first voice coil 331 from one side thereof, passing through a connecting portion of the first voice coil 331 with the second voice coil 332, and then surrounding the second voice coil 332 by one circle, then winding from the second voice coil 332 to the first voice coil 331, passing again the connection portion of the first voice coil 331 with the second voice coil 332, and finally surrounding the first voice coil 331 by one circle. In this way, the stability is good, and the swing phenomenon of the speaker 100 can be suppressed. Of course, other winding methods may also be employed as long as they could achieve the same technical effect, and thus they shall be considered as falling within the scope of protection of the present invention.

One end of the fixed connecting portion of the first voice coil 331 with the second voice coil 332 is suspended between the first magnet steel 421 and the second magnet steel 422, and the other end is abut against the dome 32. As the position of fixed connecting portion of the first voice coil 331 with the second voice coil 332 could support the dome 32, the resonance phenomenon of the dome 32 at a high frequency is suppressed, and as cutoff frequency of the speaker 100 at high frequency is increased, the sensitivity of the speaker 100 at high frequency is flatter, and thus the hearing of the product is better.

The speaker 100 further includes a front cover 2 fitted with the basin frame 1, and the front cover 2 is provided with an opening portion 21. The opening portion 21 is configured for transmitting sounds generated by the vibration of the speaker 100.

The speaker 100 further includes a conductive terminal 11 disposed on the basin frame 1, the conductive terminal 11 is configured for connecting with an external circuit.

Compared with the related art, the speaker provided by the present disclosure has at least one of the following advantageous effects:

1. The dual voice coils are disposed symmetrically and in parallel, thus compared with the single voice coil products, the utilization of the magnetic field is improved, the vibration driving force is thereby improved, and the resonance frequency of the speaker is reduced due to the increase of mass of the voice coils.

2. The connecting portion of the two voice coils could support the dome, and thus the resonance phenomenon of the dome at high frequency is suppressed, the cutoff frequency of the speaker at high frequency is increased, and the sensitivity of the speaker at high frequency is flatter, thereby providing better feeling.

3. The two voice coils are made by integrally wound-molded, which has good stability and could suppress shaking phenomenon during vibration of the speaker.

4. A central magnetic steel is replaced by two magnetic steels with smaller volume, which could greatly reduce the magnetic field leakage of the speaker unit and avoid interference with other electrical components.

The above description only illustrates the embodiments of the present invention. It should be noted that those skilled in the art may make improvements thereto without departing from the inventive concept of the present disclosure, which shall be considered as falling within the protection scope of the present invention.

What is claimed is:

1. A speaker, comprising a basin frame with a receiving space, a vibration system disposed at the basin frame, and a magnetic circuit system configured for driving the vibration system to generate sounds by vibration, wherein, the vibration system comprises a diaphragm with an outer edge fixedly held by the basin frame and a voice coil fixed to the diaphragm and configured for driving the diaphragm to vibrate, wherein, the voice coil comprises a first voice coil and a second voice coil fixedly connected to the first voice coil, the first voice coil and the second voice coil are disposed in parallel and symmetrically, the first voice coil and the second voice coil are integrally wound molded and a winding direction of the first voice coil is opposite to that of the second voice coil, the magnetic circuit system comprises a first magnetic steel fitted with the first voice coil and a second magnetic steel fitted with the second voice coil, the first magnetic steel and the second magnetic steel are spaced apart and disposed in parallel, a magnetic field direction of the first magnetic steel is opposite to that of the second magnetic steel, a connecting portion of the first voice coil and the second voice coil is inserted to a space between the first magnetic steel and the second magnetic steel.

2. The speaker according to claim 1, wherein a height of the first voice coil is the same as that of the second voice coil.

3. The speaker according to claim 1, wherein the speaker further comprises a conductive terminal disposed at the basin frame, the conductive terminal comprises a first conductive terminal and a second conductive terminal, the voice coil comprises a first lead wire leading from the first voice coil and a second lead wire leading from the second voice coil, the first lead wire is electrically connected to the first conductive terminal, the second lead wire is electrically connected to the second conductive terminal.

4. The speaker according to claim 1, wherein the speaker further comprises a front cover fitted with the basin frame, and the front cover is provided with an opening portion disposed in the middle of the front cover.

5. The speaker according to claim 1, wherein a width of the connecting portion of the first voice coil and the second voice coil is larger than that of the rest portion of the voice coil, the connecting portion of the first voice coil and the second voice coil is fixed to a center of the diaphragm.

* * * * *